United States Patent [19]

Suzuki et al.

[11] Patent Number: 4,889,098

[45] Date of Patent: Dec. 26, 1989

[54] AIR-FUEL RATIO DETECTING APPARATUS FOR AN INTERNAL COMBUSTION ENGINE EQUIPPED WITH A HEATER CONTROLLER

[75] Inventors: Hiroyoshi Suzuki, Himeji; Ryoji Nishiyama, Amagasaki; Shinichi Nishida, Himeji, all of Japan

[73] Assignee: Mitsubishi Denki Kabushiki Kaisha, Tokyo, Japan

[21] Appl. No.: 278,403

[22] Filed: Dec. 1, 1988

[30] Foreign Application Priority Data

Dec. 1, 1987 [JP] Japan ..... 62-304960

[51] Int. Cl.[4] ..... F02M 51/00; F02D 41/14

[52] U.S. Cl. ..... 123/489; 123/440

[58] Field of Search ..... 123/489, 440, 491; 204/424, 425, 426

[56] References Cited

U.S. PATENT DOCUMENTS

| | | | |
|---|---|---|---|
| 4,472,262 | 3/1984 | Kondo et al. | 204/408 |
| 4,655,182 | 4/1987 | Nakano et al. | 123/440 |
| 4,708,777 | 11/1987 | Kuraoka | 123/440 |
| 4,715,343 | 12/1987 | Kiroshita | 204/425 X |
| 4,721,088 | 1/1988 | Miono et al. | 123/489 |
| 4,732,128 | 3/1988 | Yoshioka et al. | 123/489 |
| 4,753,204 | 6/1988 | Kojima et al. | 123/489 |
| 4,765,298 | 8/1988 | Kojima et al. | 123/489 |

FOREIGN PATENT DOCUMENTS

| | | | |
|---|---|---|---|
| 169751 | 2/1985 | Japan | 123/440 |

*Primary Examiner*—R. A. Nelli

*Attorney, Agent, or Firm*—Sughrue, Mion, Zinn, Macpeak and Seas

[57] ABSTRACT

An air-fuel ratio detecting apparatus for an internal combustion engine of an automotive vehicle has an air-fuel ratio sensing element disposed in the exhaust manifold of the engine, an electric heater which heats the sensing element to above its activation temperature, and a controller which controls the heater output in accordance with the operating state of the engine, a target air-fuel ratio, and at least one parameter selected from the speed of the vehicle and a temperature parameter so as to maintain the temperature of the sensing element constant even when the exhaust gas temperature of the engine varies.

6 Claims, 7 Drawing Sheets

AIR-FUEL RATIO DETECTING APPARATUS FOR AN INTERNAL COMBUSTION ENGINE EQUIPPED WITH A HEATER CONTROLLER

BACKGROUND OF THE INVENTION

This invention relates to an air-fuel ratio detecting apparatus for an internal combustion engine, and more particularly but not exclusively, it relates to an air-fuel ratio detecting apparatus for the engine of an automotive vehicle.

Recently, in order to accurately control the air-fuel ratio of the air-fuel mixture entering the cylinders of internal combustion engines, air-fuel ratio detectors have been installed on the exhaust manifolds of engines. Components of the exhaust gas of an engine which are correlated to the air-fuel ratio are detected by the air-fuel ratio detector, and the fuel supply is controlled by feedback so as to obtain a target value for the air-fuel ratio.

This type of air-fuel ratio detector generally has a sensing element and a heater which heats the sensing element to an activation temperature. A sensor of this type is described in Japanese Published Unexamined Pat. Application No. 60-58548.

The temperature of the exhaust gas of an internal combustion engine greatly varies depending on the operating state of the engine (indicated by parameters such as the engine rotational speed, the air intake rate, and the intake air pressure), temperature parameters such as the engine cooling water temperature and the intake air temperature, and the vehicle speed. Since an air-fuel ratio detector is disposed inside the exhaust manifold of an engine, it is exposed to the exhaust gas of greatly varying temperature. Therefore, in order to keep the temperature of the sensing element of the air-fuel ratio detector above an activation temperature and yet not overheat the sensing element, it is necessary to adjust the output of the heater for the sensing element in accordance with the exhaust gas temperature.

In a conventional air-fuel ratio detector, the output of the heater for the sensing element is controlled in accordance with the exhaust gas temperature as indicate by the air intake rate into the engine. When the air intake rate is below a prescribed rate, this is taken as an indication that the exhaust gas temperature is below a prescribed temperature and the heater for the sensing element is turned on. Conversely, when the air intake rate is above the prescribed rate, this is taken as an indication that the exhaust gas temperature is above the prescribed temperature and the heater for the sensing element is turned off.

However, this method of heater control is not sufficiently accurate, for as discussed above, the exhaust gas temperature of an engine depends on a large number of parameters besides the air intake rate, so that even at a constant air intake rate, the exhaust gas temperature can vary. Therefore, with this conventional method of heater control, the temperature of the sensing element can not be maintained constant.

Furthermore, over the entire operating range of the engine, variations in the exhaust gas temperature due to varying operating conditions are normally in excess of 800° C. The range of variation of exhaust gas temperatures between when the heater of a conventional air-fuel ratio detector is on and when it is off is too large, the change in the temperature of the air-fuel ratio detector becomes too large, and the temperature dependence of the air-fuel ratio detector can no longer be ignored. Therefore, accurate detection of the air-fuel ratio of exhaust gas becomes extremely difficult.

A conventional air-fuel ratio detector also has the problem that the voltage of the battery of the vehicle is directly applied to the heater for the sensing element. During the operation of the vehicle, the battery voltage can vary, and so depending on the exhaust gas temperature, it may be impossible to maintain the temperature of the sensing element above its activation temperature.

SUMMARY OF THE INVENTION

Accordingly, it is an object of the present invention to provide an air-fuel ratio detecting apparatus which can maintain the temperature of its sensing element at a constant temperature above its activation temperature over a wide range of engine operating conditions and temperatures, whereby the air-fuel ratio can be accurately detected.

In the present invention, the output of a heater for a sensing element of an air-fuel ratio detecting apparatus is controlled in accordance with the operating state of the engine, a target air-fuel ratio, and at least one parameter selected from the speed of the vehicle in which the air-fuel ratio detecting apparatus is installed and a temperature parameter. By controlling the heater output on the basis of a large number of parameters instead of merely on the air intake rate as in the prior art, the temperature of the sensing element can be constantly maintained above an activation temperature despite variations in engine operating conditions, temperature conditions, vehicle speed, and battery voltage.

An air-fuel ratio detecting apparatus for an internal combustion engine in accordance with the present invention comprises an air-fuel ratio sensing element which produces an electrical output corresponding to the concentration of a component in the exhaust gas of an internal combustion engine of a vehicle, an electric heater which is disposed in the vicinity of the sensing element so as to be able to heat the sensing element to an activation temperature, and a controller for controlling the output of the heater in accordance with the operating state of the engine, a target air-fuel ratio, and at least one parameter selected from the speed of the vehicle and a temperature parameter.

The output of the heater for the sensing element can be controlled by several methods. In one form of the present invention, the controller varies the magnitude of the voltage which is applied to the heater. In another form of the present invention, a voltage of constant magnitude is applied to the heater in the form of pulses, and the controller controls the length of the pulses so as to obtain a suitable heater output.

The above-described operating state on the basis of which heater control is performed is indicated by at least one parameter selected from the rotational speed of the engine, the rate of air intake into the engine, the pressure of intake air, and the degree of opening of a throttle valve of the engine.

The above-described temperature parameter is one or more parameter selected from the temperature of intake air and the temperature of cooling water of the engine.

DESCRIPTION OF THE PREFERRED EMBODIMENTS

Hereinbelow, a number of preferred embodiments of an airfuel ratio detecting apparatus in accordance with the present invention will be described while referring to the accompanying drawings, FIG. 1 of which is a schematic cross-sectional view of a portion of an internal combustion engine for an automobile which is equipped with an air-fuel ratio controller employing a heater controller of the present invention. Although the present invention will be described with respect to its application to an internal combustion engine of an automotive vehicle, it is of course applicable to engines for other uses as well.

Figure 1:
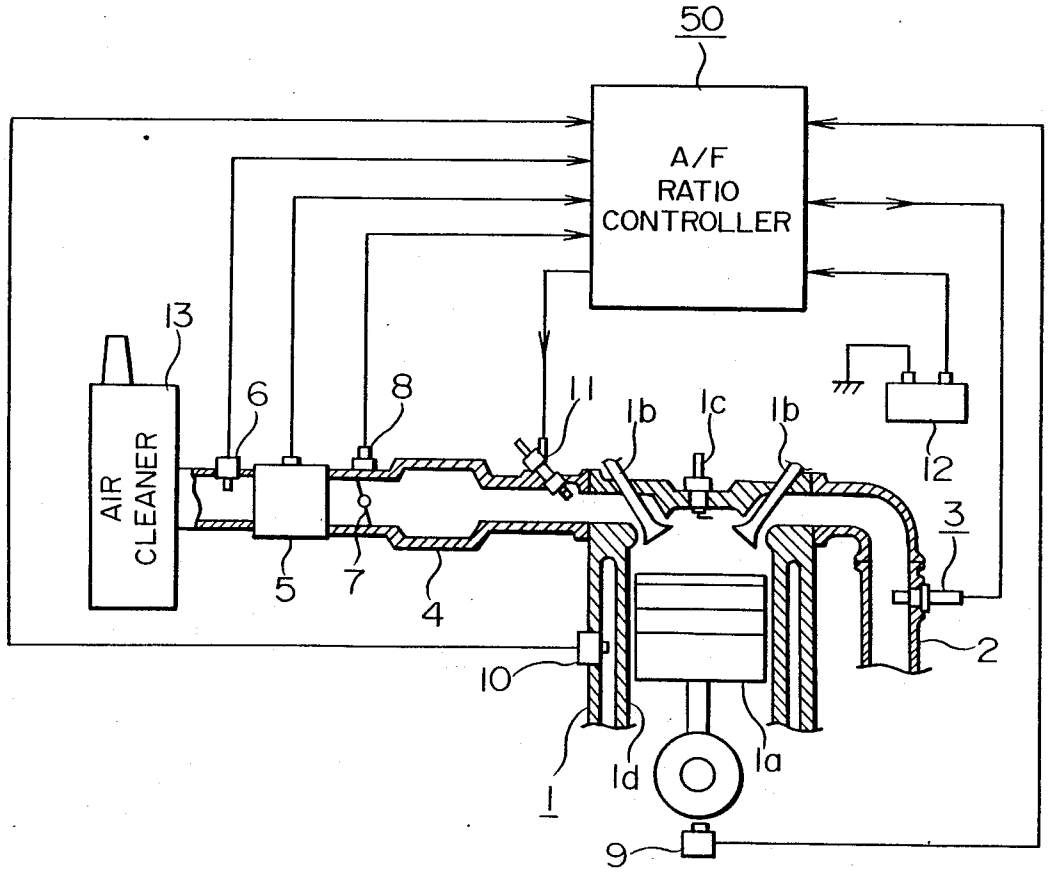
FIG. 1 is a schematic cross-sectional view of a portion of an engine which is equipped with an air-fuel ratio detecting apparatus in accordance with the present invention.

As shown in FIG. 1, an automobile engine 1 has a piston 1*a*, intake and exhaust valves 1*b*, and a spark plug 1*c* installed in an engine cylinder 1*d* in a conventional manner. For the sake of simplicity, only a single cylinder 1*d* is illustrated, but the engine 1 is equipped with a plurality of cylinders 1*d* of the same structure. An air-fuel ratio sensor 3 is mounted on its exhaust manifold 2 of the engine 1. An intake pipe 4 which opens onto the inside of the cylinder 1*d* has an air intake rate sensor 5 installed thereon which produces an electrical output signal corresponding to the rate at which air flows the intake pipe 4. An air cleaner 13 is mounted on the inlet of the intake pipe 4. An intake air temperature sensor 6 which is also mounted on the intake pipe 4 measures the temperature of the intake air and produces a corresponding electrical output signal. A throttle valve 7 is mounted inside the intake pipe 4, and a throttle opening sensor 8 which is mounted on the intake pipe 4 measures the degree of opening of the throttle valve 7 and produces a corresponding electrical output signal. A rotational speed sensor 9 which is mounted on the engine 1 measures the rotational speed thereof and produces a corresponding output signal. The temperature of the cooling water for the engine 1 is measured by a cooling water temperature sensor 10 which is mounted on the engine block and produces a corresponding electrical output signal. The output signals from sensors 3, 5, 6, 8, 9, and 10 are provided as inputs to an air- fuel ratio controller 50 which is powered by the battery 12 of the automobile. The controller 50 controls the operation of a fuel injector 11 which is mounted on the intake pipe 11. The controller 50 also functions as a controller for the air-fuel ratio detecting apparatus of the present invention.

Figure 2:
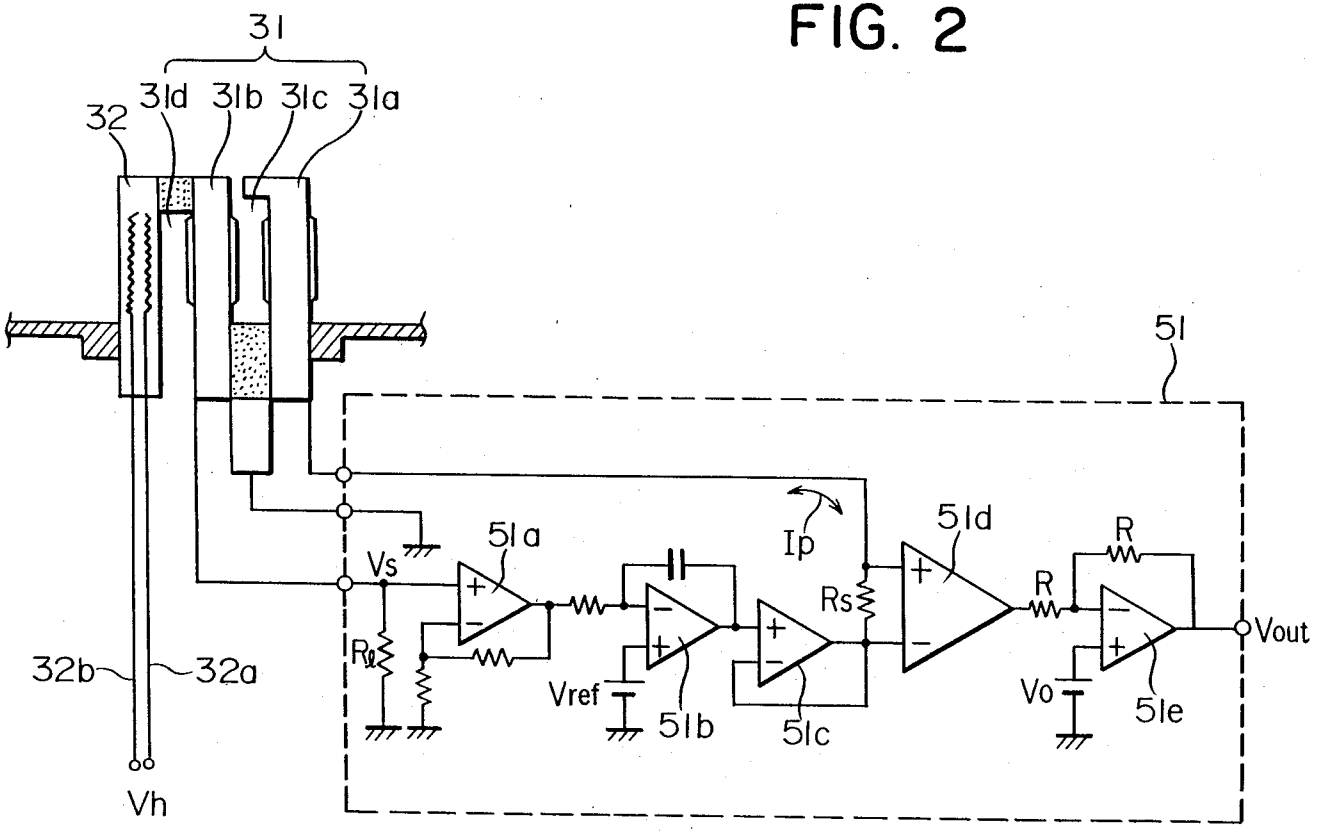
FIG. 2 is a schematic diagram of an air-fuel ratio sensor of the embodiment of FIG. 1 and a detection circuit therefor.

The air-fuel ratio sensor 3 comprises a sensing element 31 and a heater 32 which are schematically illustrated in FIG. 2 along with a detecting circuit 51 therefor which is housed inside the controller 50. The sensing element 31 is a conventional device of the type described in Japanese Published Unexamined Pat. Application No. 60-169751, for example. It has an oxygen pump 31*a*, an oxygen concentration cell 31*b* which confronts the oxygen pump 31*a*, an exhaust gas diffuser 31*c* formed between the oxygen pump 31*a* and the oxygen concentration cell 31*b*, and a reference oxygen portion 31*d* which is open to the atmosphere. In order to function properly, the sensing element 31 must be heated to above a prescribed activation temperature by a heater 32 which is disposed adjacent thereto. The heater 32 is equipped with two leads 32*a* and 32*b* through which a heater voltage is applied.

When the engine is operating and the sensing element 31 is in an activated state, the oxygen concentration cell 31*b* generates an electromotive force Vs corresponding to the difference between the oxygen concentration in the exhaust gas diffusion portion 31*c* and that in the reference oxygen portion 31*d*. This electromotive force Vs is applied to the non-inverting input terminal of a preamplifier 51*a* of the detecting circuit 51. The amplified output of the preamplifier 51*a* is applied to the inverting input terminal of a differential integrator 51*b*, to whose non-inverting input terminal is applied a reference voltage Vref. The output of the differential integrator 51*b* is applied to the non-inverting input terminal of a follower 51*c*, and the output of the follower 51*c* is applied to the inverting input terminal of a differential amplifier 51*d* and to the non-inverting input terminal thereof through a resistor Rs. A control current Ip is caused to flow through the oxygen pump 31*a* in accordance with the difference between Vref and the voltage applied to the inverting input terminal of the integrator 51*b*. The current Ip is proportional to the concentration of components in the exhaust gas, which are correlated to the air-fuel ratio. The value of Vref is chosen so that the current Ip is negative when the air- fuel mixture is lean, so that Ip is positive when the air-fuel mixture is rich, and so that Ip is zero for a stoichiometric air- fuel ratio. The output of the differential amplifier 51*d*, which is proportional to the control current Ip, is applied to the inverting input terminal of an amplifier 51*e* whose non-inverting input terminal is connected to a reference voltage Vo corresponding to a stoichiometric air-fuel ratio. The positive output voltage Vout of amplifier 51*e* indicates the air-fuel ratio.

Figure 3:
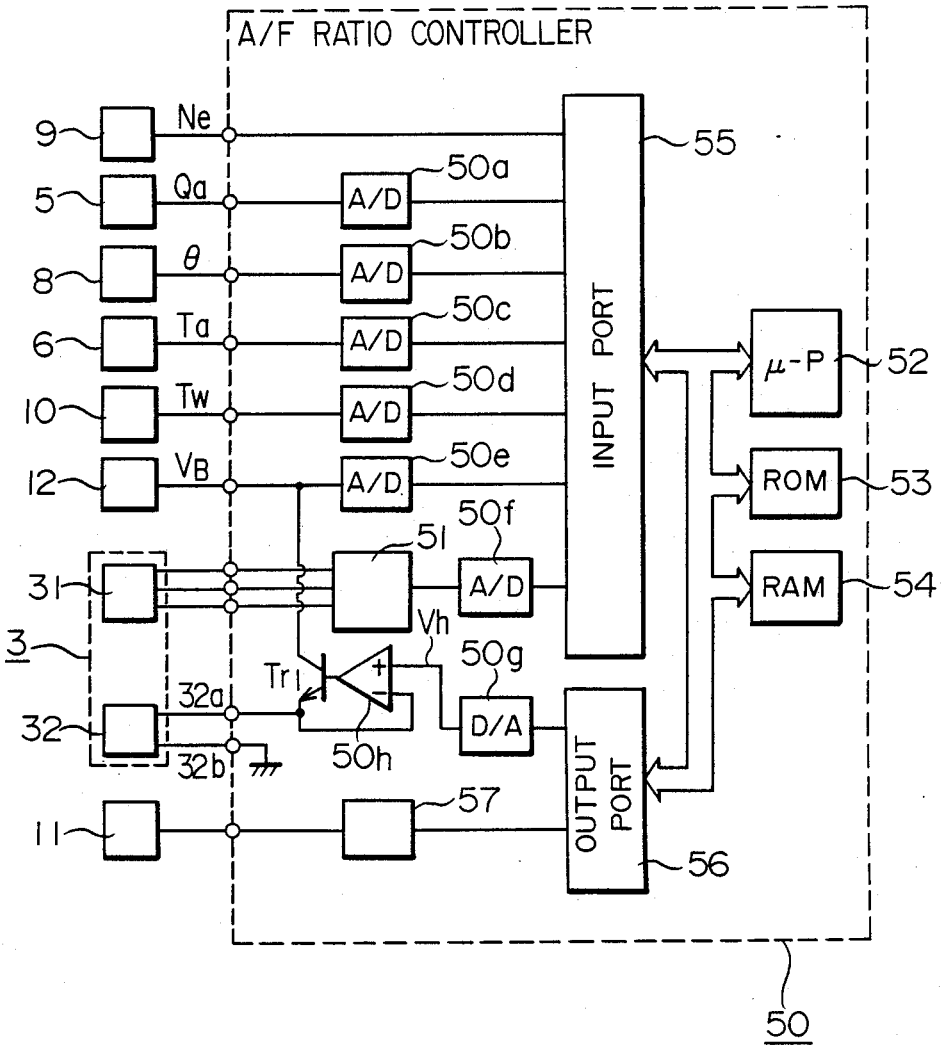
FIG. 3 is a block diagram of an air-fuel ratio controller equipped with a first embodiment of an air-fuel ratio detecting apparatus in accordance with the present invention.

FIG. 3 is a block diagram of the air-fuel ratio controller 50 of FIG. 1 which also serves as a controller for a first embodiment of an air-fuel ratio detecting apparatus in accordance with the present invention. Analog/digital (A/D) converters 50*a*–50*e* are connected between an input port 55 and the air intake rate sensor 5, the throttle valve opening sensor 8, the intake air temperature sensor 6, the cooling water temperature sensor 10, and the battery 12. The output of the rotational speed sensor 9 is provided directly to the input port 55. Another A/D converter 50f is connected between the output terminal of the detecting circuit 51 of FIG. 2 and the input port 55. The input port 55 is connected to a microprocessor 52, which is connected to a ROM 53, a RAM 54, and an output port 56. The RAM 54 is used for temporary storage of data during calculations. The output port 56 is connected to an amplifier 50h through a digital-/analog (D/A) converter 50g. The output terminal of the amplifier 50h is connected to the base of a transistor Tr1. The collector of the transistor Tr1 is connected to the battery 12, and the emitter is connected to one of the leads 32a of the heater 32 and to the inverting terminal of the amplifier 50h as a feedback signal. With this arrangement, the voltage which is applied to the heater 32 is always maintained equal to the voltage which is applied to the non-inverting input terminal of the amplifier 50h, regardless of variations in the voltage Vb of the battery 12. The output port 56 is also connected to the fuel injector 11 through a fuel control circuit 57.

Figure 6A:
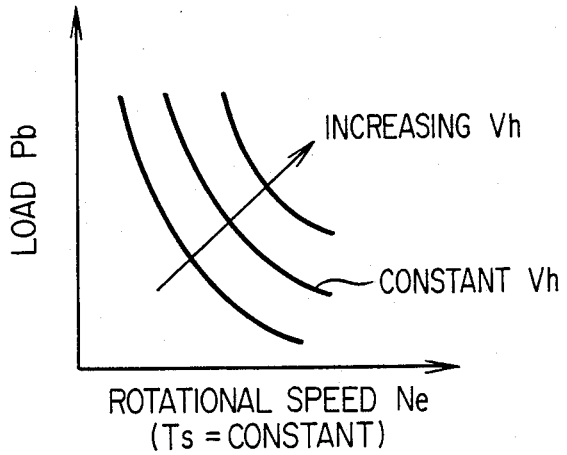
FIGS. 6*a* is a graph showing the relationship between engine load and engine rotational speed for various values of heater demand voltage.

As explained earlier, the voltage which must be applied to the heater 32 in order to keep the temperature Ts of the sensing element 31 at a prescribed temperature which is at least as high as the temperature for activation depends on the operating conditions of the engine. This voltage will be referred to as the heater demand voltage Vh. FIG. 6a shows the heater demand voltage Vh for a constant value of the sensor temperature Ts as a function of the rotational speed Ne of the engine and the load Pb on the engine. It can be seen that the heater demand voltage Vh increases as the rotational speed Ne or the load Pb increases. It also increases as the exhaust gas temperature rises.

Figure 6B:
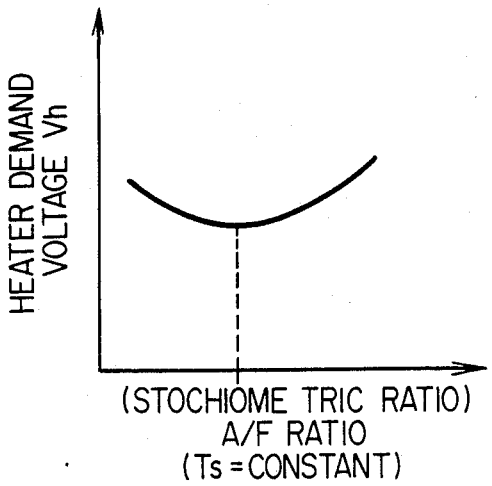
FIG. 6*b* is a graph showing the relationship between the heater demand voltage and the air-fuel ratio.

FIG. 6b shows the relationship between the heater demand voltage Vh and the air-fuel ratio A/F for a constant sensor temperature Ts. The exhaust gas temperature is a maximum for a stoichiometric air-fuel ratio and decreases when the air-fuel mixture is either rich or lean. Therefore, the heater demand voltage Vh is a minimum for a stoichiometric air-fuel ratio and increases in regions in which the mixture is either rich or lean.

Figure 6C:
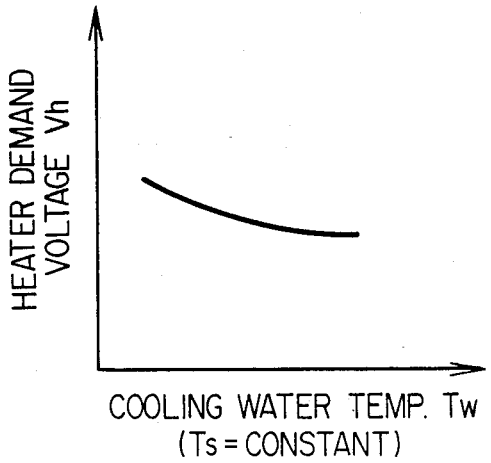
FIG. 6*c* is a graph showing the relationship between heater demand voltage and engine cooling water temperature.

FIG. 6c shows the relationship between the heater demand voltage Vh and the cooling water temperature Tw of the engine for a constant value of the sensor temperature Ts. The exhaust gas temperature is roughly proportional to the cooling water temperature Tw, so the heater demand voltage Vh is roughly inversely proportional to the cooling water temperature Tw. The relationship between the heater demand voltage Vh and the intake air temperature Ta shows roughly the same tendency.

The relationships illustrated in FIGS. 6a–6c are stored in the ROM 53 of the air-fuel ratio controller 50 of FIG. 3 and are employed to compute the heater demand voltage Vh based on input signals to the controller 50 from the various sensors.

Next, the operation of the air-fuel ratio controller 50 will be described for the case in which the engine rotational speed Ne and the air intake rate Qa are used as parameters indicating the engine operating state. Based on a program which is stored with the ROM 53, input signals corresponding to the engine rotational speed Ne and the air intake rate Qa are input to the microprocessor 52, which calculates the engine load Pb according to the formula Pb =Qa/Ne. An initial target air-fuel ratio corresponding to the calculated value of Pb is then read from the ROM 53.

Next, signals corresponding to the air intake temperature Ta and the cooling water temperature Tw are input to the microprocessor 52, and based on these temperatures, the initial target air-fuel ratio is corrected to obtain a final target airfuel ratio.

The actual air-fuel ratio under the present operating conditions is detected by the air-fuel ratio sensor 3, and a corresponding output signal Vout is generated by the detecting circuit 51. This signal is input to A/D converter 50f, and a digitalized signal is input to the microprocessor 52 through the input port 55.

The microprocessor 52 compares the final target air-fuel ratio with the actual air-fuel ratio, and the operating time for the fuel injector 11 is calculated so that the actual air-fuel ratio will become equal to the final target air-fuel ratio. A corresponding control signal is sent to the fuel control circuit 57 through the output port 56, and the fuel injector 11 is operated to spray fuel for the calculated length of time.

During acceleration or deceleration, the throttle valve opening $\theta$ is used for feed-forward control in which the amount of fuel is temporarily increased or decreased.

Figure 7:
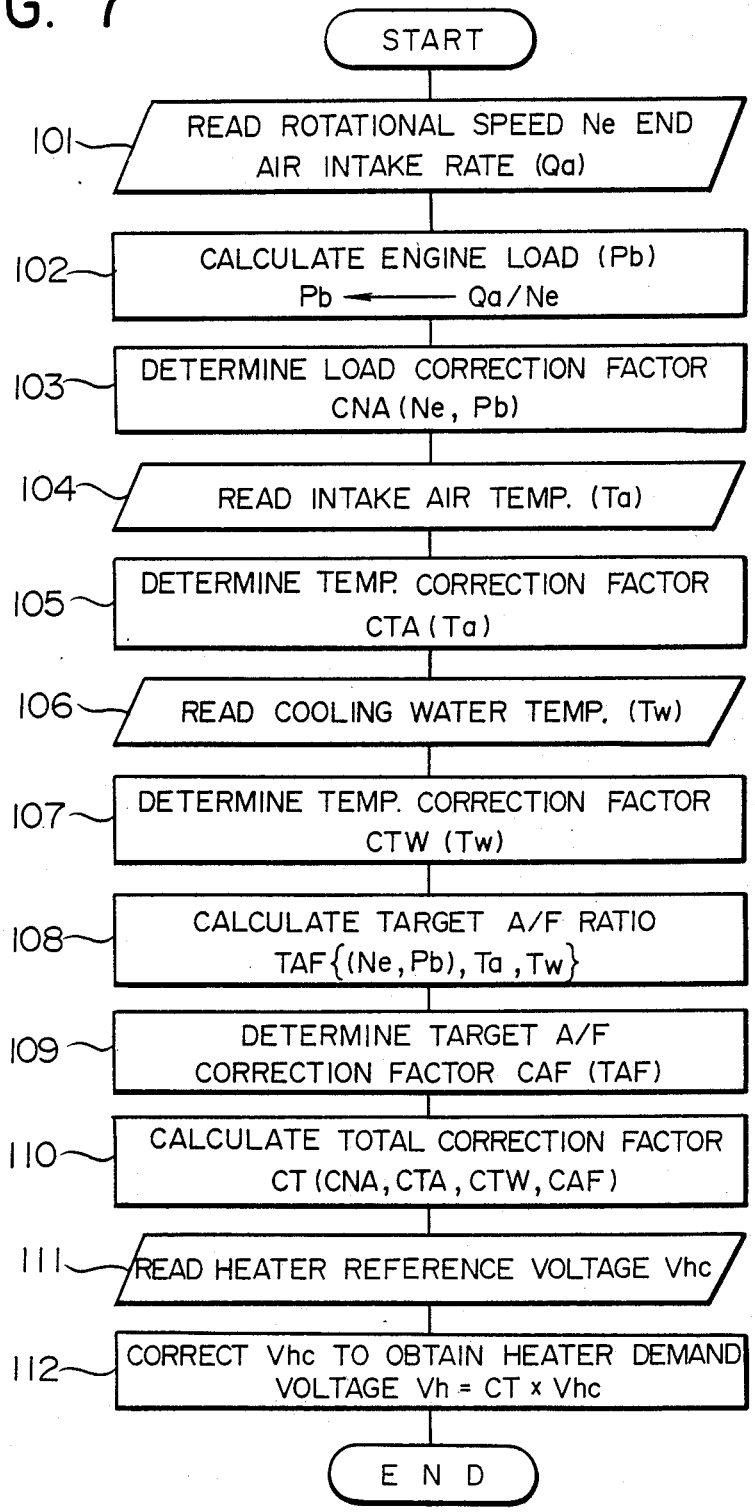
FIG. 7 is a flow chart showing the operation of the airfuel ratio controller of FIG. 3 when calculating the heater demand voltage. In the figures, the same reference numerals indicate the same or corresponding parts.

FIG. 7 is a flow chart of a method performed by the fuelair ratio controller 50 for calculating the heater demand voltage Vh. First, in Step 101, electrical signals corresponding to the air intake rate Qa and the engine rotational speed Ne are input to the microprocessor 52 from the air intake rate sensor 5 and the rotational speed sensor 9, respectively. These two values Qa and Ne are used as parameters which indicate the operating state of the engine. In Step 102, the microprocessor 52 then calculates the load Pb on the engine=Qa/Ne.

Next, in Step 103, the value of a correction factor CNA for the heater demand voltage Vh which is a function of Ne and Pb is read into the microprocessor 52 from the ROM 53.

In Step 104, a signal corresponding to the value of the intake air temperature Ta is input to the microprocessor 52 from the intake air temperature sensor 6. In Step 105, a correction factor CTA for the heater demand voltage Vh which is a function of the intake air temperature Ta is read from the ROM 53.

Similarly, in Step 106, a signal corresponding to the cooling water temperature Tw is input to the microprocessor 52 from the cooling water temperature sensor 10, and a correction factor CTW for the heater demand voltage Vh which is a function of the cooling water temperature Tw is read from the ROM 53.

Then, in Step 108, a target air-fuel ratio TAF is calculated based on the values of Ne, Pb, Ta and Tw. In Step 109, a correction factor CAF which corresponds to the target air-fuel ratio TAF is read from the ROM 53.

In Step 110, the above-determined correction factors CNA, CTA, CTW and CAF are combined to form a total correction factor CT. Generally, the total correction factor CT is determined by a function having CNT, CTA, CTW and CAF as its variables. For example, CT is given by the following formulae.

$$CT = CNA \cdot CTA \cdot CTW \cdot CAF \text{ or}$$

$$CT = \frac{\eta_1 \cdot CNA + \eta_2 \cdot CTA + \eta_3 \cdot CTW + \eta_4 \cdot CAF}{\eta_1 + \eta_2 + \eta_3 + \eta_4}$$

In Step 111, a heater reference voltage Vhc corresponding to prescribed reference values for the parameters Ne, Pb, Ta, Tw and TAF is read from the ROM 53 into the microprocessor 52, and in Step 112, the heater reference voltage Vhc is corrected, i.e., multiplied by the total correction factor CT to give a heater demand voltage Vh, and a digital signal corresponding to the value of Vh is output to the output port 56.

The D/A converter 50g converts this digital signal into an analog signal having a magnitude of Vh and applies it to the noninverting input terminal of amplifier 50h. Due to the feedback from transistor Tr1 to the amplifier 50h, the emitter voltage of the transistor Tr1 is always maintained equal to the heater demand voltage Vh. Therefore, even when changes in the operating state of the engine causes the exhaust gas temperature to change, the temperature Ts of the sensing element 31 of the air-fuel ratio sensor 3 can be always maintained at a constant level which is above its activation temperature. As a result, accurate detection of the air-fuel ratio of the engine exhaust gas can always be performed.

In the preceding embodiment, no consideration is given to the speed of the vehicle except insofar as it is reflected in the various operating parameters. However, for a constant engine operating state, it is possible for the vehicle speed to vary. If the vehicle speed rises, the cooling of the exhaust manifold 2 is increased due to increased flow of air over its exterior surface and its temperature falls. As a result, the rate of thermal transmission from the exhaust gas to the exhaust manifold 2 increases and the temperature of the exhaust gas falls. In addition, the rate of thermal transmission from the air-fuel ratio sensor 3 to the exhaust manifold 2 also increases as the vehicle speed increases. Therefore, the temperature Ts of the fuel sensing element 31 falls, so the heater demand voltage Vh must be increased in order to maintain the sensor temperature Ts constant.

Figure 4:
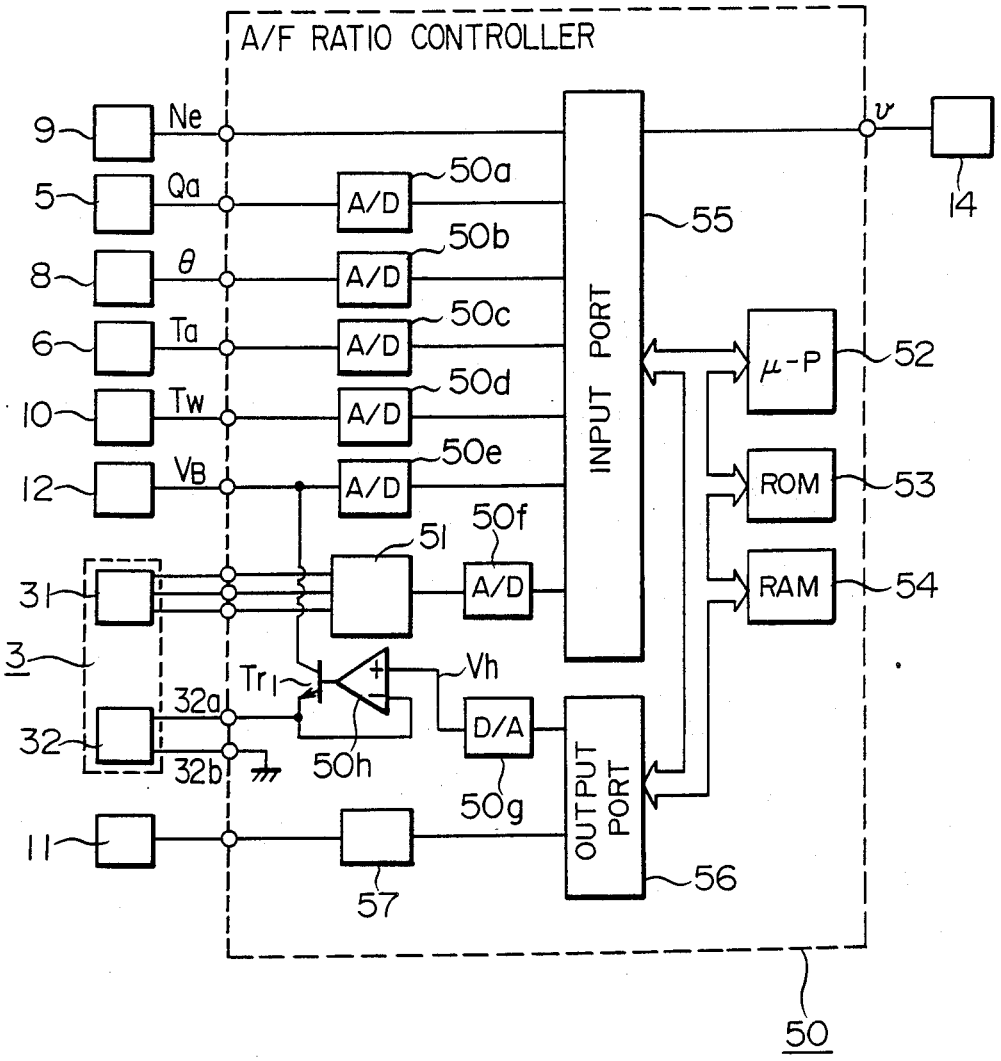
FIG. 4 is a block diagram of an air-fuel ratio controller equipped with a second embodiment of an air-fuel ratio detecting apparatus in accordance with the present invention.

FIG. 4 illustrates a controller 50 for a second embodiment of an air-fuel ratio detecting apparatus in accordance with the present invention which is further equipped with a vehicle speed sensor 14 which generates an electrical output signal corresponding to the speed v of the vehicle. This signal is input to the microprocessor 52 via the input port 55. The structure of this embodiment is otherwise identical to that of the embodiment of FIG. 3.

The ROM 53 stores correction factor data CV relating changes in the heater demand voltage Vh due to changes in the temperature of the sensing element 31 due to the speed v of the vehicle. After the heated demand voltage Vh has been calculated in the manner shown in the flow chart of FIG. 7, it is further corrected for the vehicle speed v by the correction factor CV corresponding to the vehicle speed v indicated by the vehicle speed sensor 14. Preferably, the correction factor CV is determined by engine load Pb and vehicle speed v. For example, CV is given as a point g (Pb, v) on a two-dimensional map which is illustrated by engine load Pb and vehicle speed v. As a result, the temperature of the sensing element 31 can be maintained all the more constant, and the accuracy of control of the air-fuel ratio is further increased.

In the above-described embodiment, the heater reference voltage Vhc is a maximum voltage which corresponds to the case in which the exhaust gas temperature is a minimum. Furthermore, it is below the allowable maximum rated voltage for the heater 32. In addition, the total correction factor CT has a value of at most 1. Therefore, the heater demand voltage Vh which is computed in Step 112 is always less than or equal to the reference voltage Vhc and is therefore less than the allowable maximum rated voltage for the heater 32.

As a result, even if the correction CT takes on an incorrect value due to malfunction of one of the sensors, the allowable maximum rated voltage for the heater 32 is never exceeded and damage to the heater 32 by overheating can be prevented.

Figure 5:
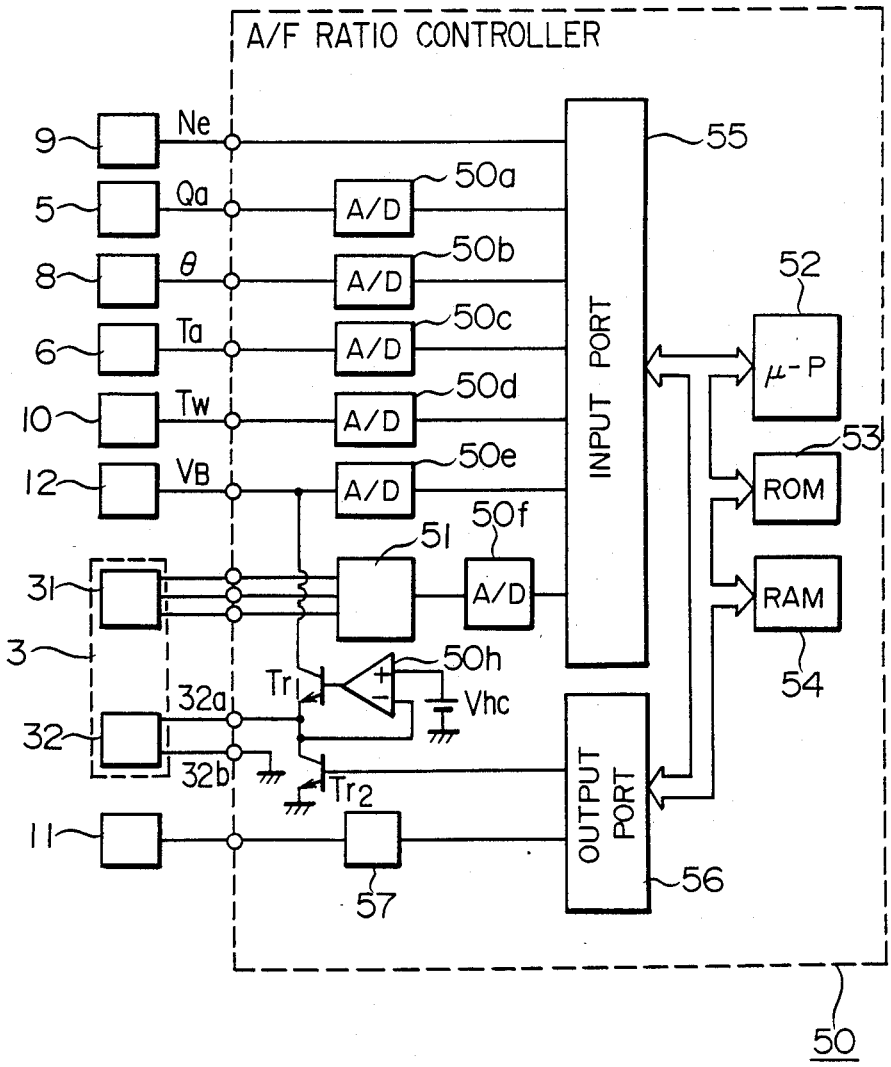
FIG. 5 is a block diagram of an air-fuel ratio controller equipped with a third embodiment of an air-fuel ratio detecting apparatus in accordance with the present invention.

In the preceding two embodiments, the output of the heater 32 is regulated by controlling the magnitude of the voltage which is applied thereto. In a third embodiment of the present invention, a constant voltage is applied to the heater 32, and the output of the heater 32 is regulated by controlling the length of time for which this constant voltage is applied to the heater 32. FIG. 5 is a block diagram of an air-fuel ratio controller incorporating this third embodiment. This embodiment differs from the embodiment of FIG. 3 in that the D/A converter 50g is deleted and a reference voltage Vhc is applied to the noninverting input terminal of amplifier 50h. The collector of a second transistor Tr2 is connected to the emitter of transistor Tr1, and the emitter voltage of transistor Tr1 is applied as a feedback signal to the inverting input terminal of amplifier 50h. The base of transistor Tr2 is connected to the output port 56. The emitter voltage of transistor Tr1, which is applied to the heater 32, is therefore always equal to Vhc. The structure of this embodiment is otherwise identical to that of the embodiment of FIG. 3.

Based on the engine operating state, the target air-fuel ratio, and the temperature of the engine as indicated by Ta and Tw, the microprocessor 52 calculates a percentage of time for which the heater 32 should be turned on. This percentage corresponds to the total correction factor CT. The output port 56 applies a zero output to the base of transistor Tr2 for this percentage of time, and for the remainder of time, a low-voltage pulse is applied to the base of transistor Tr2 to turn it on. Current flows through the heater 32 only when transistor Tr2 is off, so during the percentage of time that the output of the output port 56 is low, the reference voltage Vhc is applied to the heater 32.

Thus, in this embodiment, the temperature Ts of the sensing element 31 which is produced by the heater 32 is controlled by using a constant reference voltage Vhc and adjusting the length of time for which this voltage is applied. In this embodiment as in the previous embodiments, the temperature Ts of the sensing element 31 of the air-fuel ratio sensor 3 can be maintained constant.

In each of the preceding embodiments, the engine rotational speed Ne and the air intake rate Qa were used as engine operating parameters corresponding to the exhaust gas temperature. However, instead of the air intake rate Qa, it is possible to employ the intake air pressure or the degree of opening of the throttle valve 7 as operating parameters and obtain the same effects.

Furthermore, in the preceding embodiments, the heater reference voltage Vhc was corrected on the basis of both the intake air temperature Ta and the cooling water temperature Tw. However, it is possible to maintain the temperature of the sensing element 32 adequately constant based on only one of these two temperatures. Furthermore, adequate control of the heater 32 can be performed even if only one parameter selected from the vehicle speed and the engine temperature parameters is employed.

What is claimed is:

1. An air-fuel ratio detecting apparatus for an internal combustion engine comprising:

a sensing element which produces an electrical output corresponding to the concentration of a component in the exhaust gas of an internal combustion engine of a vehicle;

an electric heater which is disposed in the vicinity of said sensing element so as to be able to heat said sensing element to an activation temperature; and a controller for controlling the output of said heater in accordance with the operating state of the engine, a target airfuel ratio, and at least one parameter selected from the speed of the vehicle and a temperature parameter so as to maintain the temperature of said sensing element at a constant level of at least the activation temperature.

2. An air-fuel ratio detecting apparatus as claimed in claim 1, wherein said controller comprises means for applying a variable voltage to said electric heater.

3. An air-fuel ratio detecting apparatus as claimed in claim 1, wherein said controller comprises means for applying a constant voltage to said electric heater for a variable length of time.

4. An air-fuel ratio detecting apparatus as claimed in claim 3, wherein said voltage which is applied to said heater is in the form of pulses.

5. An air-fuel ratio detecting apparatus as claimed in claim 1, wherein said operating state is indicated by at least one parameter selected from the rotational speed of the engine, the rate of air intake into the engine, the pressure of intake air, and the degree of opening of a throttle valve of the engine.

6. An air-fuel ratio detecting apparatus as claimed in claim 1, wherein said temperature parameter is one or more parameter selected from the temperature of intake air and the temperature of cooling water of the engine.

* * * * *